US006455997B1

(12) United States Patent
Lee

(10) Patent No.: US 6,455,997 B1
(45) Date of Patent: Sep. 24, 2002

(54) DEFLECTION YOKE HAVING MAGNETS ON THE TOP AND BOTTOM OF THE FLANGE PORTION OF THE HOLDER

(75) Inventor: Seok Moon Lee, Kyungsangbuk-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/287,122

(22) Filed: Apr. 7, 1999

(30) Foreign Application Priority Data

Apr. 7, 1998 (KR) ..... 98/12274

(51) Int. Cl.[7] ..... H01J 29/70

(52) U.S. Cl. ..... 313/440; 313/430; 35/210; 35/211; 35/213

(58) Field of Search ..... 313/440–441, 313/421, 429, 430, 431, 432, 433–435, 461, 477 R, 479; 335/210, 211, 212, 213; 358/248, 249

(56) References Cited

U.S. PATENT DOCUMENTS 4,143,345 A * 3/1979 Barkow ..... 335/212
5,150,003 A * 9/1992 Shin ..... 313/440
5,719,464 A * 2/1998 Honda ..... 313/440

OTHER PUBLICATIONS

B.D. Cullity, "Introduction to Magnetic Materials", Jun. 1972, Addison–Wesley Publishing, pp. 522–553.*

Patent Abstract of Japanese publication No. 02142034 publication date May 31, 1990.

Patent Abstract of Japanese publication No. 57038546 publication date Mar. 5, 1982.

Patent Abstract of Japanese publication No. 05266826 publication date Oct. 15, 1993.

* cited by examiner

*Primary Examiner*—Michael H. Day
*Assistant Examiner*—Mack Haynes
(74) *Attorney, Agent, or Firm*—Birch, Stewart, Kolasch & Birch, LLP

(57) ABSTRACT

Deflection yoke for a cathode ray tube including horizontal and vertical deflection coils for deflection of electron beams emitted from an electron gun in horizontal and vertical directions, respectively, a ferrite core disposed to surround the vertical deflection coil for improving a magnetic efficiency, an holder adapted to fix positions of the horizontal and vertical deflection coils and the ferrite core and insulate the horizontal and vertical deflection coils, and a magnet provided on an upper side and a lower side of a flange part formed at a screen side of the holder for canceling a magnetic field leaked from the horizontal deflection coil at the screen side of the holder.

10 Claims, 7 Drawing Sheets

DEFLECTION YOKE HAVING MAGNETS ON THE TOP AND BOTTOM OF THE FLANGE PORTION OF THE HOLDER

BACKGROUND OF THE INVENTION

1. Field of the Invention

The present invention relates to a deflection yoke for a cathode ray tube, and more particularly, to a saddle-saddle type deflection yoke for a cathode ray tube, which has a magnet for canceling a leakage magnetic field coming from the deflection yoke.

2. Background of the Related Art

A related art deflection yoke has a horizontal deflection coil having a current of very low frequency of 15.75 KHz or over applied there to synchronous to a video signal and a vertical deflection coil 30 having a current of extreme low frequency applied thereto. The vertical and horizontal deflection coils having the current applied there to generate vertical and horizontal magnetic fields respectively, to deflect electron beams emitted from the electron gun to a given region on a screen. In the meantime, because the magnetic field from the current of the very low frequency might harm the human body, there have been many suggestions which can prevent leakage of magnetic field from the cathode ray tube caused by the very low frequency current.

FIG. 1 illustrates a perspective view of a related art deflection yoke for a cathode ray tube disclosed in Korea Patent publication No. 96-7241, and FIG. 2 illustrates a longitudinal section of the deflection yoke in FIG. 1, schematically.

Referring to FIGS. 1 and 2, the related art deflection yoke 10 is provided with horizontal and vertical deflection coils 20 and 30 for deflecting electron beams emitted from an electron gun, a ferrite core 40 disposed to surround an outer side of the vertical deflection yoke for improving a magnetic efficiency, a holder 50 for fixing positions of the horizontal and vertical deflection coils 20 and 30 and the ferrite core 40 and insulating between the horizontal and vertical deflection coils 20 and 30, and cancel coils 531 and 532 wound on bobbins 52 respectively fitted to an upper side and lower side of a flange formed on a screen side of the holder 50.

FIG. 3 illustrates a circuit showing connection of the horizontal deflection coil 20 and the cancel coils 531 and 532.

Referring to FIG. 3, each of the cancel coils 531 and 532 is connected to a circuit of the horizontal deflection coil 20, and is connected in series. The cancel coils 531 and 532 are connected to the horizontal deflection coil 20 for generating magnetic fields from a screen side of the holder 51 opposite to the leakage magnetic field generated in the horizontal deflection coil 20. According to this, as shown in FIG. 2, the cancel coils 531 and 532 can cancel the leakage magnetic field from the horizontal deflection coil 20 at the screen side of the deflection yoke 10 for preventing leakage of the magnetic field of the horizontal deflection coil.

However, the related art cancel coils 531 and 532 has the following problems.

First, as inductances of the cancel coils 531 and 532 are added to an inductance of the horizontal deflection coil 20, the inductance of the horizontal deflection coil 20 should be reduced, which drops a horizontal deflection power of the horizontal deflection coil, to reduce a size of an image. However, if a horizontal deflection current is increased for enlarging the image size, a heat generation characteristic of the deflection yoke 10 is deteriorated, to drop a performance of the deflection yoke 10.

Second, during the horizontal deflection current is fed back, a current charged in the cancel coils 531 and 532 wound on the bobbins 52 is discharged. FIG. 4 illustrates an example of ringing of an image caused by discharge of a current from the cancel coils 531 and 532. Though the ringing may be prevented by providing a resistor 60 and a condenser 70 parallel to the cancel coils 531 and 532, it results increased numbers of components and production man-hours.

SUMMARY OF THE INVENTION

Accordingly, the present invention is directed to a deflection yoke for a cathode ray tube that substantially obviates one or more of the problems due to limitations and disadvantages of the related art.

An object of the present invention is to provide a deflection yoke for a cathode ray tube, which causes no performance drop and can cancel a leakage magnetic field coming from a deflection yoke without addition of any components.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the deflection yoke for a cathode ray tube includes horizontal and vertical deflection coils for deflection of electron beams emitted from an electron gun in horizontal and vertical directions, respectively, a ferrite core disposed to surround the vertical deflection coil for improving a magnetic efficiency, a holder adapted to fix positions of the horizontal and vertical deflection coils and the ferrite core and insulate the horizontal and vertical deflection coils, and a magnetic material provided on an upper side and a lower side of a flange part formed at a screen side of the holder for canceling a magnetic field leaked from the horizontal deflection coil at the screen side of the holder.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
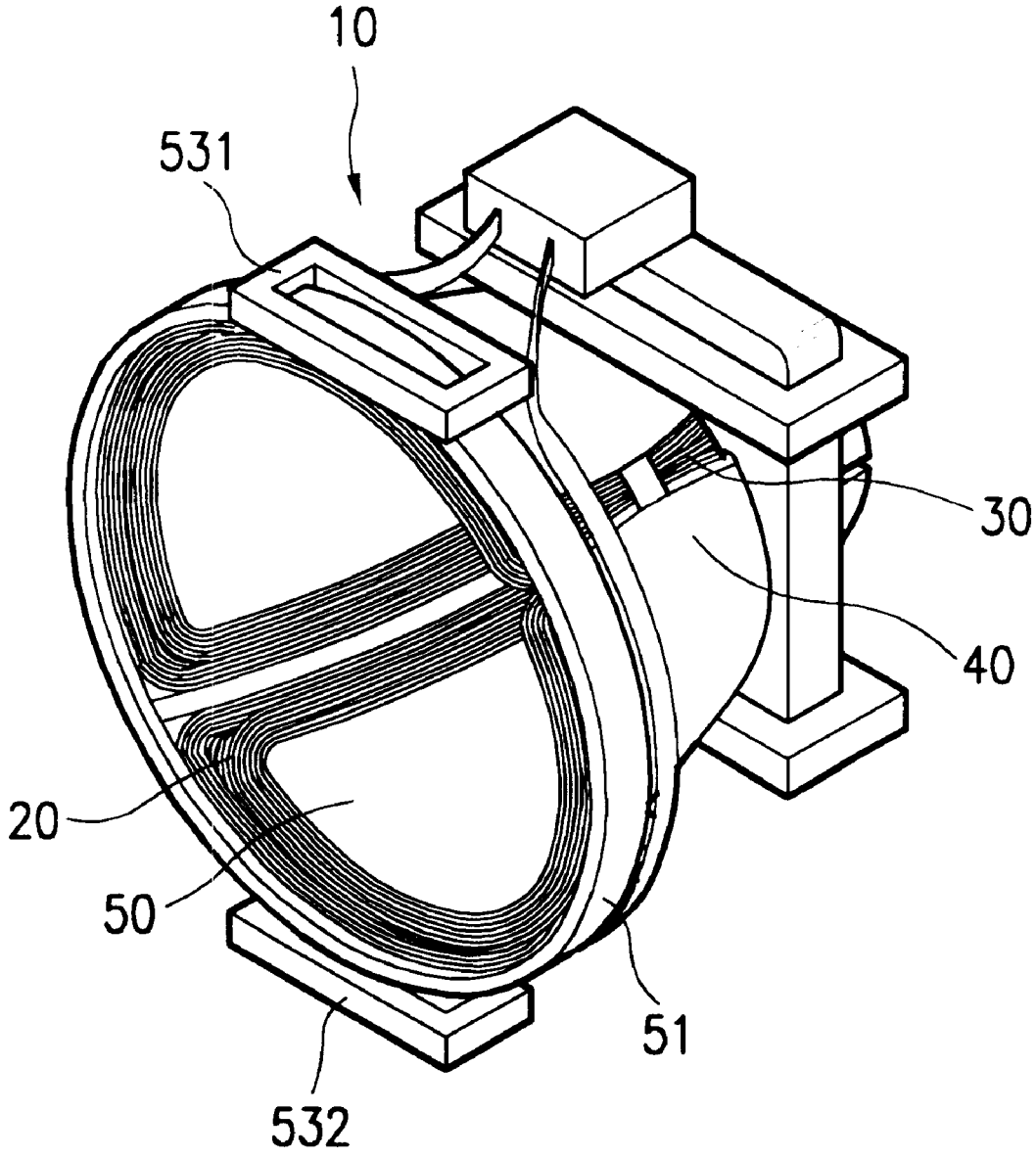
FIG. 1 Prior Art
FIG. 1 illustrates a perspective view of a related art deflection yoke.
Figure 2:
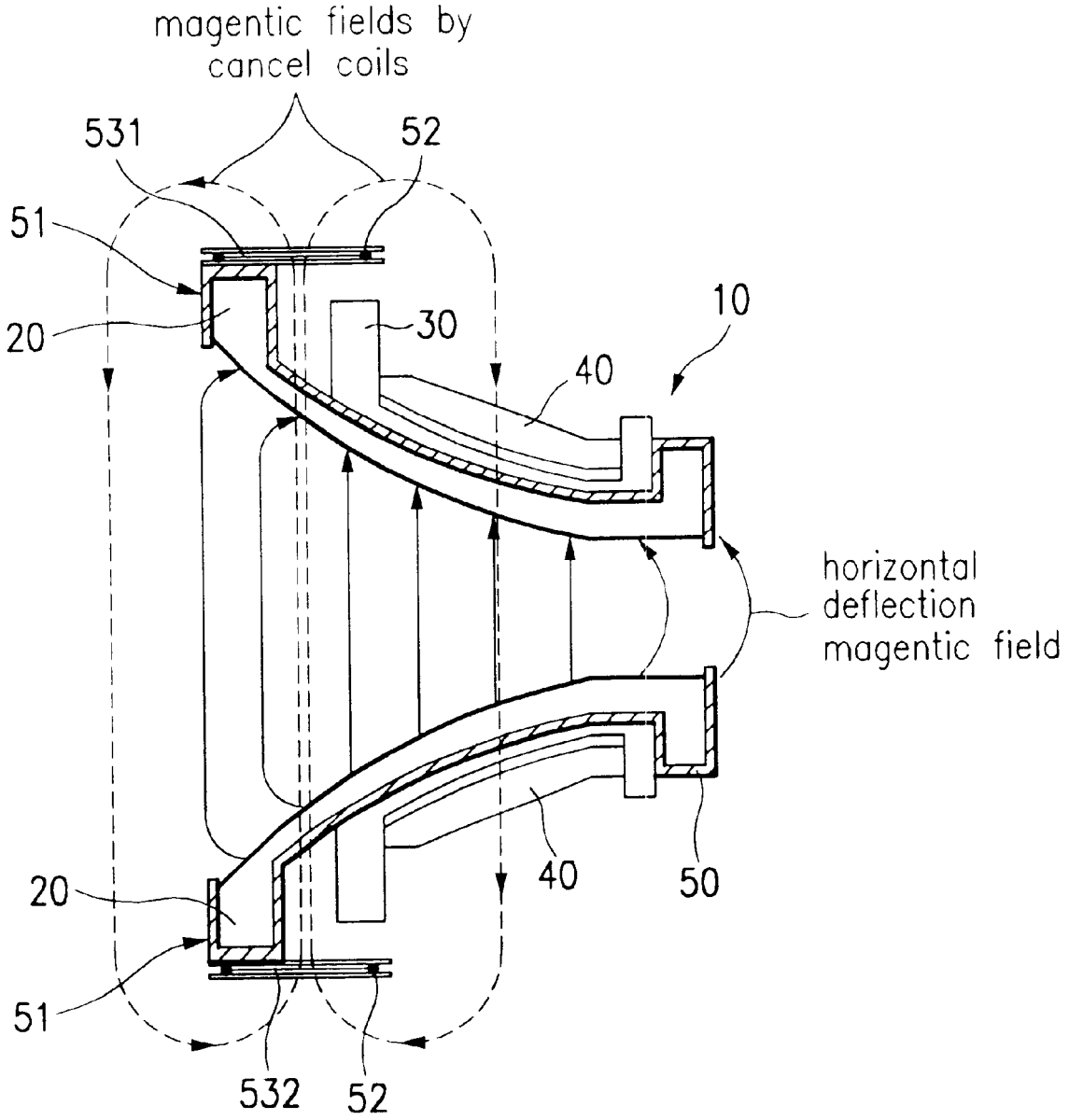
FIG. 2 Prior Art
FIG. 2 illustrates a longitudinal section of the deflection yoke in FIG. 1, schematically.
Figure 3:
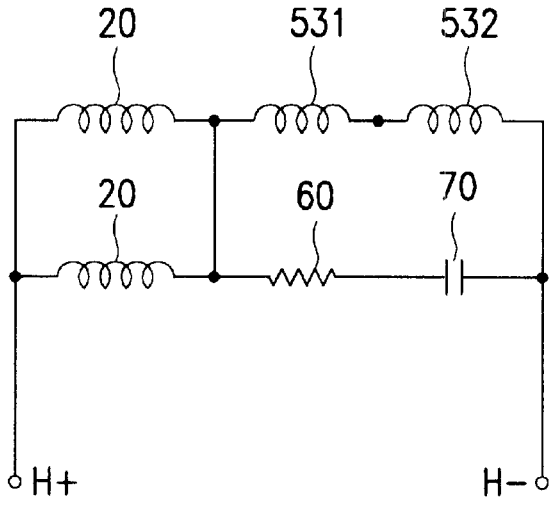
FIG. 3 Prior Art
FIG. 3 illustrates a circuit showing connection of the horizontal deflection coil and cancel coils.
Figure 4:
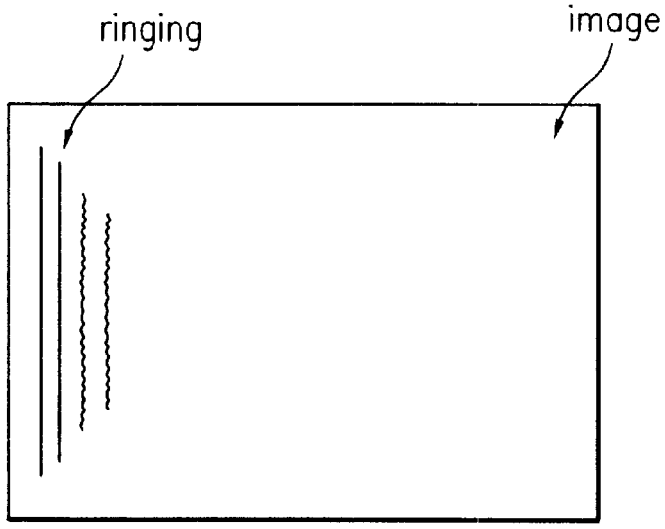
FIG. 4 Prior Art
FIG. 4 illustrates an example of ringing of an image caused by discharge of a current from cancel coils.
Figure 5:
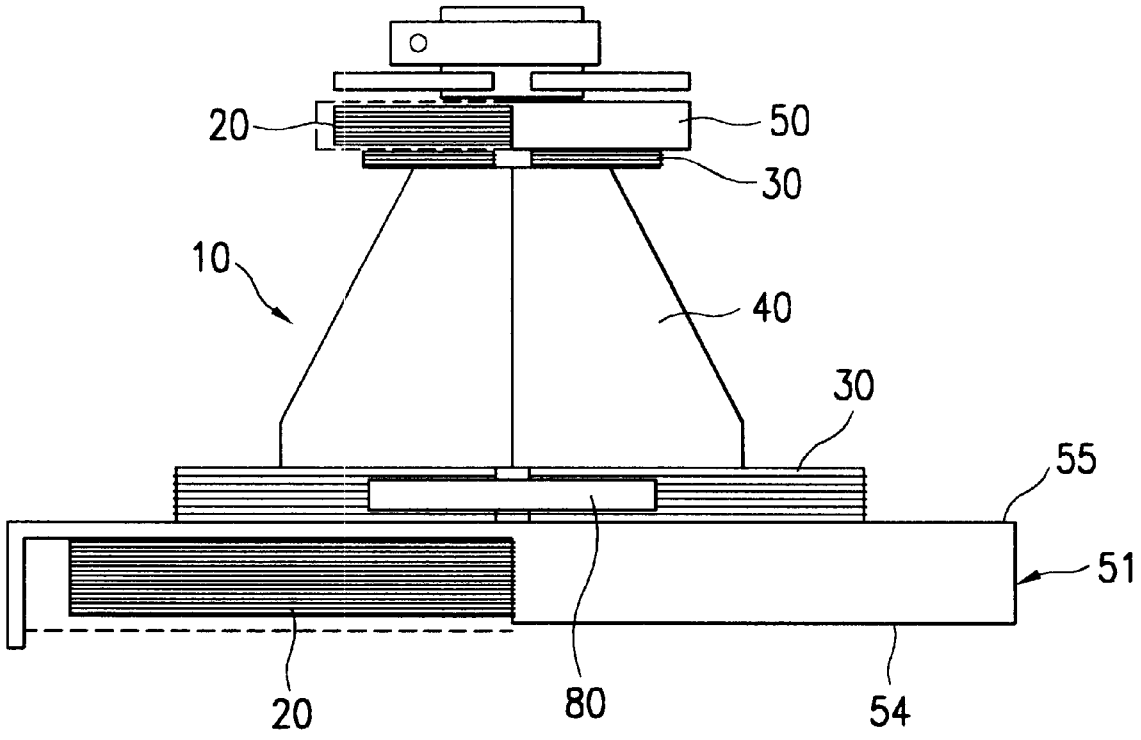
FIG. 5 illustrates a deflection yoke in accordance with one preferred embodiment of the present invention.
Figure 6:
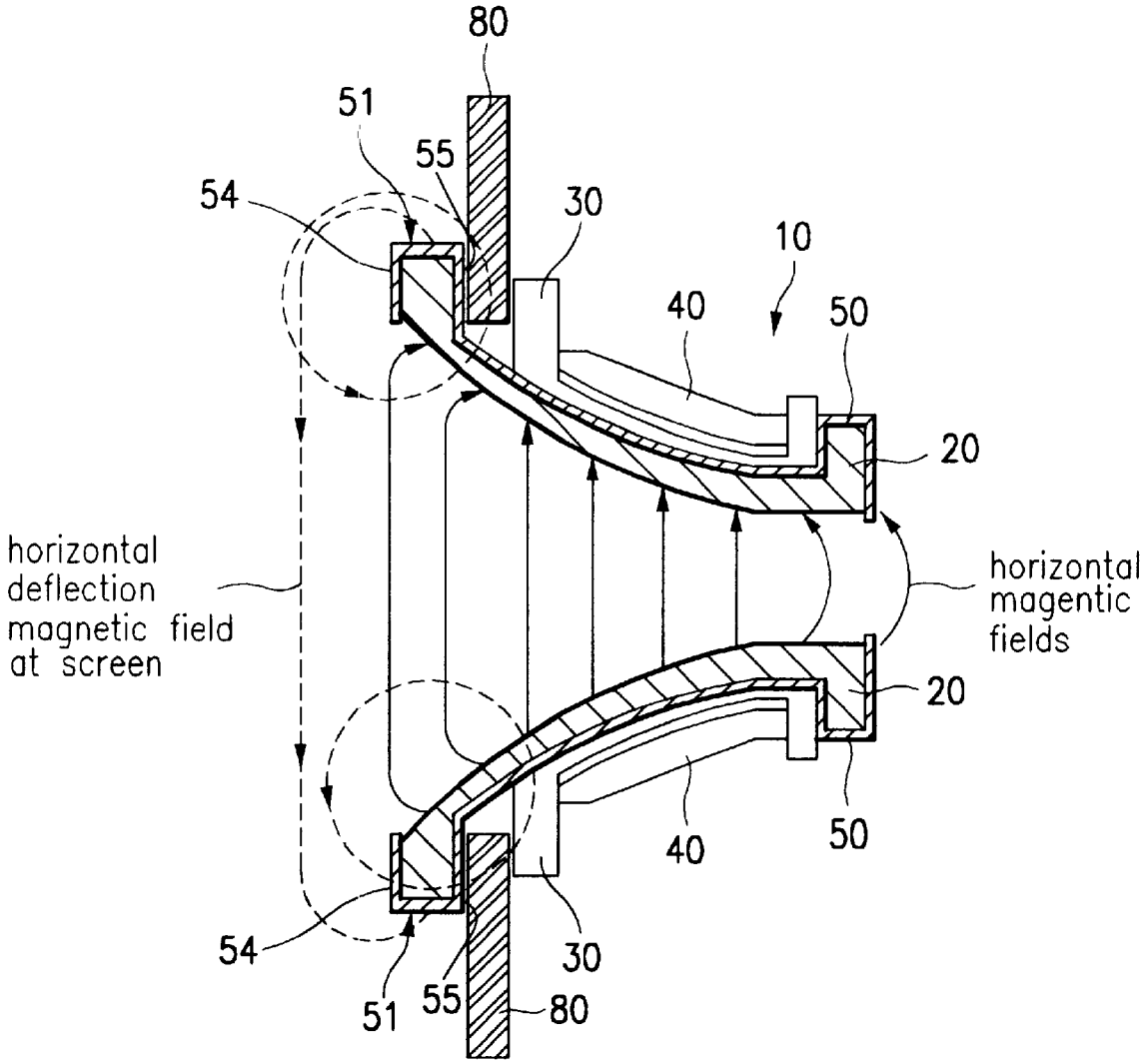
FIG. 6 illustrates a longitudinal section of the deflection yoke shown in FIG. 5.

Reference will now be made in detail to the preferred embodiments of the present invention, examples of which are illustrated in the accompanying drawings. FIG. 5 illustrates a deflection yoke in accordance with one preferred embodiment of the present invention, and FIG. 6 illustrates a longitudinal section of the deflection yoke shown in FIG. 5. As the deflection yoke for a cathode ray tube of the present invention is identical to the related art deflection yoke for a cathode ray tube except the cancel coils and the cancel circuit of the related art, components of the present invention identical to the related art are given the same reference numerals.

Figure 7:
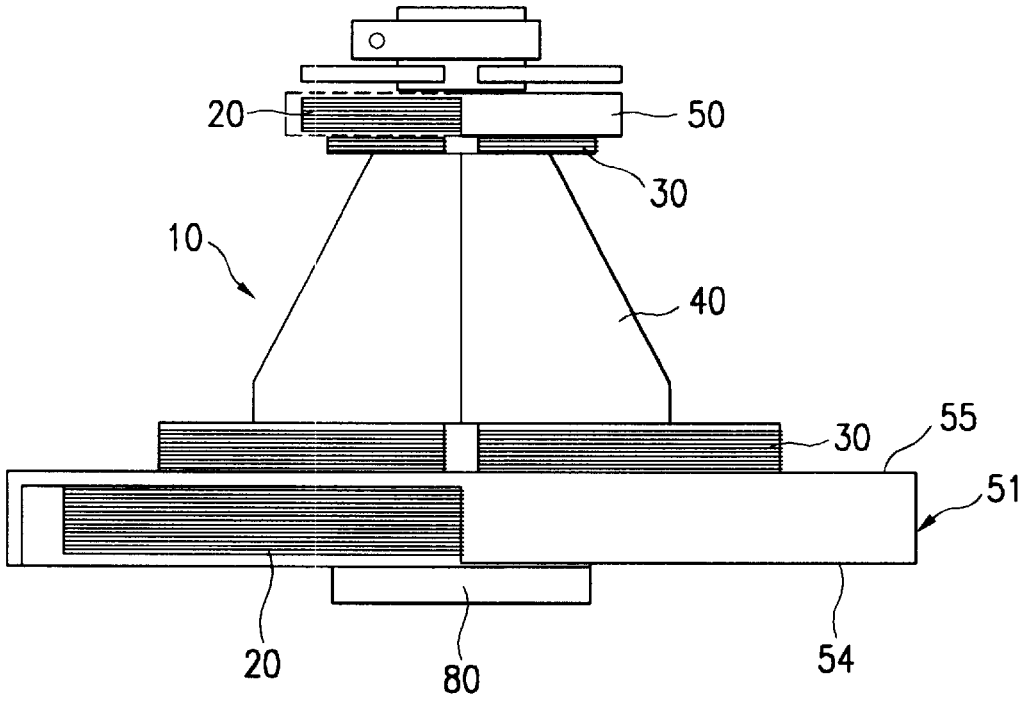
FIG. 7 illustrates a deflection yoke in accordance with another preferred embodiment of the present invention.

Referring to FIG. 6, the deflection yoke 10 in accordance with one preferred embodiment of the present invention includes horizontal and vertical deflection coils 20 and 30 for deflection of electron beams emitted from an electron gun in horizontal and vertical directions, a ferrite core 40 disposed to surround the vertical deflection coil for improving a magnetic efficiency, a holder 50 adapted to fix positions of the horizontal and vertical deflection coils 20 and 30 and the ferrite core 40 and insulate the horizontal and vertical deflection coils 20 and 30, and one pair of magnetic materials 80 provided on an upper side and a lower side of a flange 51 formed at a screen side of the holder 50 for canceling a magnetic field leaked from the horizontal deflection coil 20 at the screen side adjacent to a screen which is one end of the holder 50. The magnetic materials 80 are mounted on upper and lower parts 55 of the holder 50 right behind the flange 51 at the screen side of the holder 50 to position the magnetic materials 80 in a magnetic field region of the horizontal deflection coil 20 and 30 leaking toward the screen side and disposed to generate a magnetic field of a polarity opposite to the magnetic field from the horizontal deflection coil 20, for canceling the magnetic field leaking toward the screen side as shown in FIG. 7. It is preferable that the magnetic material 80 has a height greater than a height of the flange 51 for adequate cancellation of leakage of horizontal deflection magnetic field. It is also preferable that the magnetic material 80 is selected from the group Ni—Zn, Mg—Zn and Mn—Zn and the range of magnetic permeability of the magnetic material 80 is between 500–3000 H/m. As one specific embodiment of the present invention, when a magnetic materials 80 of hexahedral ferrite core with a size of 16 mm×60 mm×7 mm is applied to the deflection yoke 10 of the present invention, it is measured that leakage of magnetic field is reduced by approximately 44% compared to the related art.

FIG. 7 illustrates a deflection yoke for a cathode ray tube in accordance with a second preferred embodiment of the present invention, wherein magnetic materials 80 are mounted on upper and lower parts 55 of the holder 50 in front of the flange 51 and disposed to generate a magnetic field of a polarity opposite to the magnetic field from the horizontal deflection coil 20, for canceling a horizontal deflection magnetic field leakage according to a principle as shown in FIG. 7

Figure 8A:
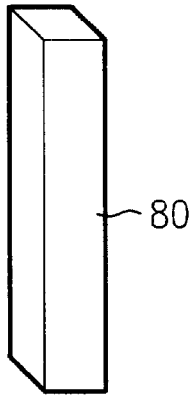
FIGS. 8A~8C illustrate perspective views of various magnets in accordance with preferred embodiments of the present invention.
Figure 8B:
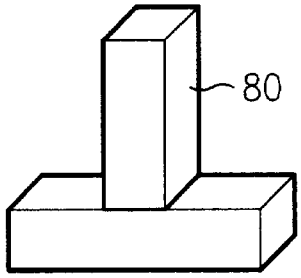
Figure 8C:
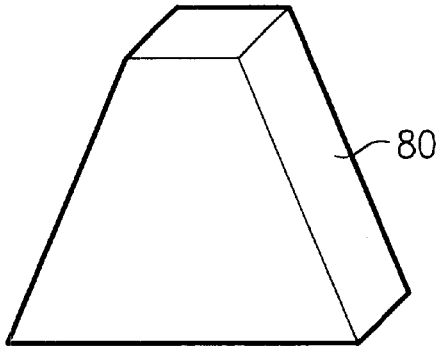

FIGS. 8A~8C illustrate perspective views of various magnets in accordance with preferred embodiments of the present invention, wherefrom it can be known that a shape of the magnet 80 may be varied with a shape of the deflection coil.

The deflection yoke for a cathode ray tube of the present invention has the following advantages.

The capability of independent cancellation of the leakage magnetic field without connection to the horizontal deflection coil by the magnets of the present invention, eliminating the requirement for a reduction of an inductance of the horizontal deflection coil as in the case of the related art coils, allows to prevent a drop of a horizontal deflection power of the horizontal deflection coil.

And, since the deflection yoke for a cathode ray tube of the present invention is provided with magnets instead of coils connected to the horizontal deflection coil, the deflection yoke for a cathode ray tube of the present invention causes no ringing during a feed back time period of a horizontal deflection, and can reduce production cost and man-hours because no resistor and no condenser are required for preventing the ringing.

It will be apparent to those skilled in the art that various modifications and variations can be made in the deflection yoke for a cathode ray tube of the present invention without departing from the spirit or scope of the invention. Thus, it is intended that the present invention cover the modifications and variations of this invention provided they come within the scope of the appended claims and their equivalents.

What is claimed is:

1. A deflection yoke for a cathode ray tube comprising:

horizontal and vertical deflection coils for deflection of electron beams emitted from an electron gun in horizontal and vertical directions, respectively;

a ferrite core disposed to surround the vertical deflection coil for improving magnetic efficiency;

a holder adapted to fix positions of the horizontal and vertical deflection coils and the ferrite core and insulate the horizontal and vertical deflection coils; and, a magnetic material provided on an upper side and a lower side of a flange part formed at a screen side of the holder for canceling a magnetic field leaked from the horizontal deflection coil at the screen side of the holder, wherein the magnetic material is formed of ferrite selected from the group consisting of Ni—Zn ferrite, Mg—Zn ferrite, and Mn—Zn ferrite.

2. A deflection yoke as claimed in claim 1, wherein the magnetic material is disposed on a front part of the flange part.

3. A deflection yoke as claimed in claim 1, wherein the magnetic material is disposed on a part behind the flange part.

4. A deflection yoke as claimed in claim 1, wherein the magnetic material has a height greater than a height of the flange part.

5. A deflection yoke as claimed in claim 1, wherein the range of magnetic permeability of the magnetic material is between 500–3000 H/m.

6. A deflection yoke as claimed in claim 1, wherein the magnetic material is rectangular hexahedral.

7. A deflection yoke as claimed in claim 1, wherein the magnetic material is trapezoidal hexahedral.

8. A deflection yoke as claimed in claim 1, wherein the magnetic material is a 'T' form.

9. A deflection yoke as claimed in claim 1, wherein the magnetic material is provided adjacent between the flange and the vertical deflection coil.

10. A deflection yoke for a cathode ray tube comprising:

a horizontal deflection coil for deflection of electron beams emitted from an electron gun in a horizontal direction;

a vertical deflection coil having a shallow trench, disposed to surround the horizontal deflection coil for deflection of electron beams emitted from an electron gun in a vertical direction;

a ferrite core inlaid in said shallow trench, disposed to surround the vertical deflection coil for improving magnetic efficiency;

a holder adapted to fix positions of the horizontal and vertical deflection coils and the ferrite core and insulate the horizontal and vertical deflection coils; and, a magnetic material provided on an upper side and a lower side of a flange part formed at a screen side of the holder for canceling a magnetic field leaked from the horizontal deflection coil at the screen side of the holder, wherein the magnetic material is formed of ferrite selected from the group consisting of Ni—Zn ferrite, Mg—Zn ferrite, and Mn—Zn ferrite.

* * * * *